United States Patent [19]

Bartlett

[11] 4,069,841

[45] Jan. 24, 1978

[54] FUEL SUPPLY SYSTEM

[76] Inventor: Lewis D. Bartlett, P.O. Box 786, Hopewell, Va. 23860

[21] Appl. No.: 720,442

[22] Filed: Sept. 3, 1976

[51] Int. Cl.[2] ..... E03B 7/07

[52] U.S. Cl. ..... 137/568; 137/569; 222/189; 222/318

[58] Field of Search ..... 222/189, 318, 56; 137/568, 569

[56] References Cited

U.S. PATENT DOCUMENTS

| | | | |
|---|---|---|---|
| 1,630,265 | 5/1927 | Holden et al. | 137/569 X |
| 1,661,450 | 3/1928 | Van Sant | 137/569 X |
| 3,234,791 | 2/1966 | Richards | 222/318 X |

*Primary Examiner*—Stanley H. Tollberg
*Attorney, Agent, or Firm*—Norman B. Rainer

[57] ABSTRACT

The service life of a filter utilized for the purification of fuel oil drawn from a storage vessel for transfer to a burner nozzle is increased by providing a holding tank, positioned between said filter and said nozzle, which permits the recycling of already filtered fuel oil. A float valve in said holding tank facilitates controlled delivery of fuel to said burner nozzle, and regulates the amount of fresh fuel drawn from the storage vessel.

1 Claim, 2 Drawing Figures

FUEL SUPPLY SYSTEM

BACKGROUND OF THE INVENTION

This invention relates to a fuel oil supply system, and more particularly to a method and apparatus for minimizing the transfer of impurities in fuel oil from a storage vessel to the site of use of said oil.

In the utilization of liquid fuels to generate heat or energize engines, filter means are generally employed to remove suspended impurities from the fuel in order to protect the equipment which utilizes said fuel. Suspended impurities can be of a solid, semi-solid or liquid nature. Although such impurities may occur by virtue of inadvertent contamination in the course of processing and transporting the fuel, most liquid hydrocarbon fuels deposit gel-like impurities merely on aging.

A commonly used system for the heating of buildings such as residential homes and industrial buildings involves the burning of a hydrocarbon fuel known as number 2 grade heating oil in a plenum chamber which heats air or water for circulation to its point of intended use. As distinguished from the more volatile kerosine, which can be ignited in an open pool, number 2 grade heating oil must be atomized or vaporized to facilitate burning. Atomization of the oil is generally achieved by means of a burner comprising a spray nozzle fed by a pump which pressurizes the oil to about 100 pounds per square inch, or higher. The storage vessel for the heating oil generally consists of an underground reservoir tank located outside the building.

The pump which pressurizes the oil for atomization also serves to withdraw the oil from the storage tank through a pipline known as a suction line. Because the pump is designed to be self-purging and self-priming, it withdraws more oil from the storage reservoir than it actually pressurizes for burning. The excess oil is returned to the reservoir via a separate pipeline known as the return line. In the operation of a typical oil burner unit for heating a private residential dwelling, oil is taken from the storage tank at a rate of about 16 to 20 gallons per hour, the delivery through the nozzle may range from about 0.75 to 3.0 gallons per hour, and the remaining oil is returned to the storage tank.

A filter is positioned within the suction line between the pump and the storage tank to protect the pump and nozzle from impurities suspended in the oil. Separate supplemental filters or strainers may additionally protect the pump and nozzle.

In the course of prolonged storage, the fuel oil forms gel particles, most of which settle to the bottom of the reservoir tank to form a sludge-like deposit. When a new supply of oil is added to the storage tank, its turbulent effect stirs up the sludge sediment, causing considerable amounts of sludge to be drawn into the filter. When the filter becomes clogged with sludge, the system will either function improperly, or will cease functioning. Restoration of a malfunctioning fuel oil system may require cleaning or replacement of the filter, nozzle, pump and/or supply lines.

It is an object of the present invention to prolong the operating effectiveness of a filter in the suction line of a fuel oil transfer system. It is another object to prolong the operating effectiveness of a fuel oil filter preceding a burner by minimizing the amount of oil passed through said filter while maintaining satisfactory operation of said burner. Other objects and advantages will become apparent hereinafter.

The use of supplementary fuel storage reservoirs or tanks interposed between an underground storage tank and equipment for the use or transit of the fuel have been earlier disclosed. Such supplementary reservoirs, as the tank and associated float valve disclosed in U.S. Pat. No. 1,595,503, have generally served as overflow tanks in metering systems. The use of a supplementary tank in a manner so as to secure improvements in filter effectiveness has not heretofore been disclosed or suggested.

SUMMARY OF THE INVENTION

The objects of the present invention are accomplished in general by modifying the fuel flow arrangement of a conventional oil burner system having a storage reservoir equipped with a suction or removal pipeline and return pipeline, an oil burner positioned at an elevation above said storage reservoir and comprised of a pump and nozzle, and a filter situated in said suction pipeline. The modification comprises the interposition of a holding tank in said return pipeline in a manner such that filtered, unconsumed oil is returned by the pump to said holding tank, and oil for delivery to the burner is preferentially taken from said holding tank and routed to said burner through a portion of said suction pipeline.

DETAILED DESCRIPTION OF THE INVENTION

Figure 1:
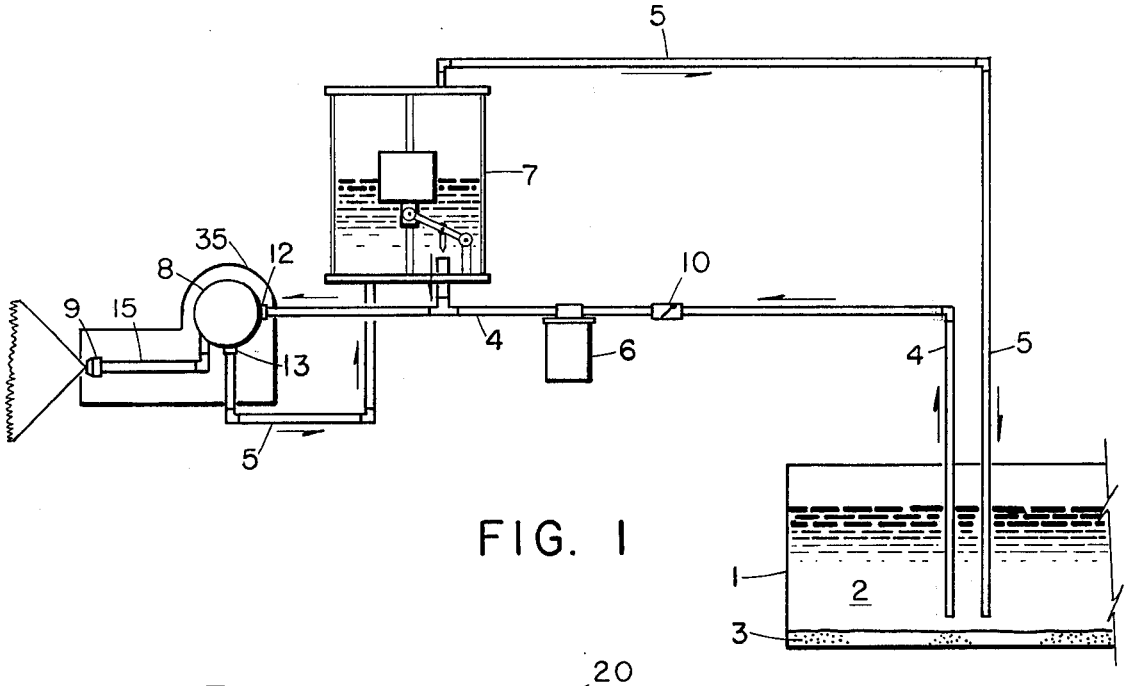
FIG. 1 is a schematic view of the fuel handling system of the present invention incorporating holding tank 7.

Referring to FIG. 1, the subterranean storage reservoir 1, containing fuel oil 2, is equipped with suction pipeline 4 and return pipeline 5, said pipelines entering through the top and terminating near the bottom of said reservoir. Any sludge material that has formed in the fuel will normally be present as a sediment 3 at the bottom of reservoir 1. The suction line 4 proceeds upwardly from the reservoir 3, and travels to the upstream or suction port 12 of pump 8 enclosed in housing 35. Operatively interposed between the pump 8 and reservoir 3 in said suction line 4 are filter 6 and check valve 10. Said check valve 10 is adapted to permit the fuel in suction pipeline 4 to flow only in the direction toward pump 8, as indicated by the arrows of FIG. 1 showing the direction of fuel flow within the pipelines.

A small portion of the fuel entering suction port 12 of pump 8 is pressurized to a pressure in the range of 80–200 psi, and exits the pump through the high pressure port 14, from whence it travels through high pressure line 15 to the spray nozzle 9. The major portion of the fuel entering suction port 12 exits from the downstream or return port 13. Return pipeline 5 commences at return port 13, proceeds to holding tank 7, and continues from the top of said tank to storage reservoir 1.

Figure 2:
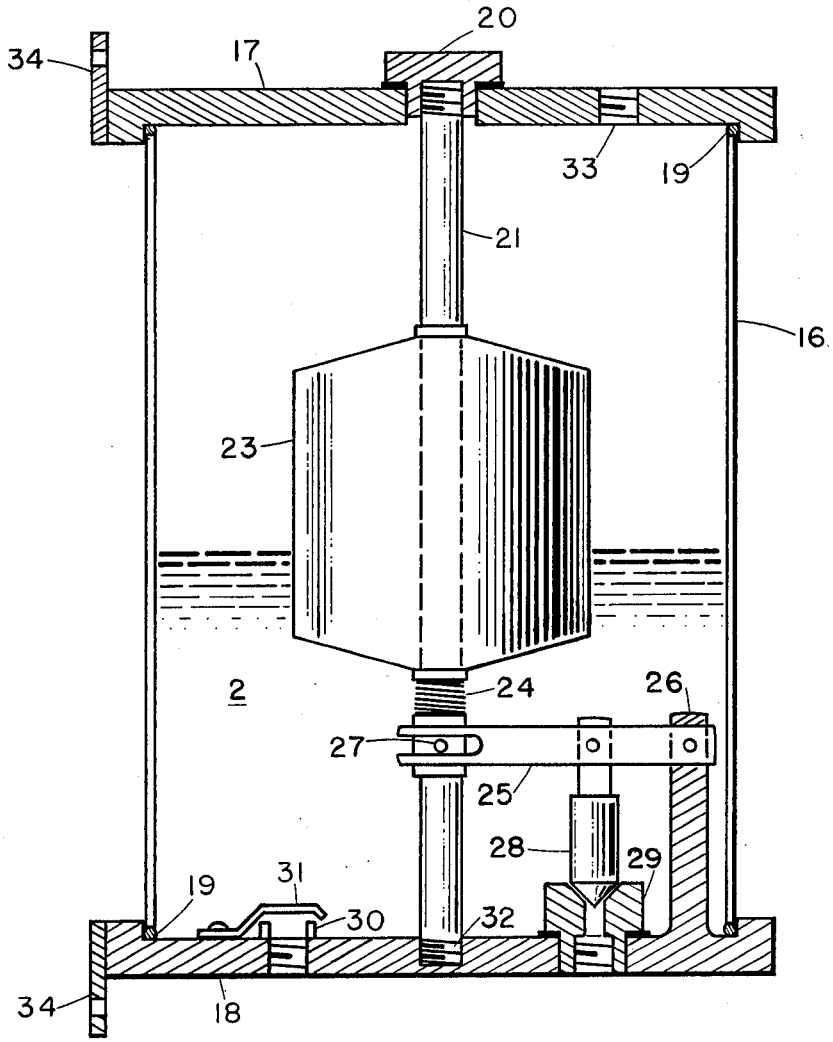
FIG. 2 is a vertical sectional view of the holding tank 7 of FIG. 1.

The embodiment of holding tank 7 shown in FIG. 2 comprises a tubular casing 16, upper flange unit 17, lower flange unit 18, circular seals 19 adapted to prevent leakage between the ends of said casing and said flanges, locking nut 20 threadably engaged with central post 21, and a float valve mechanism associated with post 21. The float valve mechanism comprises a float 23 slideably positioned on post 21 and connected by spring 24 to bearing pin 27 which engages with the innermost end of lever 25. The outermost end of lever 25 is pivotably mounted on post 26 which is supported by lower flange 18. The conically tapered plug 28, pivotably depending from lever 25, is aligned to engage with the mating end of drain block 29 which extends through bottom flange 18 and communicates with suction line 4.

The bottom flange 18 also contains entrance pipe 30 with associated diffuser plate 31, and threaded seat 32 which accomodates the bottom of post 21. An overflow exit 33 leading into return line 5 is provided in upper flange 19, and both flanges are equipped with optional mounting brackets 34.

The storage reservoir 1 is preferably a sealed vessel such as a tank fabricated of metal or reinforced plastic. It may be located from 1 to 10 feet underground and from 1 to 140 feet remote from the burner. In addition to the suction and return pipelines, the vessel may be provided with pipeline means for filling and venting. The capacity of the vessel may range from 280 to 2,000 gallons.

The pump 8 is generally a gear-type pump of single or double stage construction. It is designed so as to remove oil from the storage tank at a rate of about 16 to 20 gallons per hour, taking the oil into its suction port. The high pressure section of the pump is designed to deliver between 0.75 and 3.0 gallons per hour of fuel to the burner nozzle. The unused fuel, namely the amount not delivered to the nozzle, exits the pump through its return port. The ratio of fuel delivered to the suction port to fuel leaving the return port is between about 1.03 and 1.25. The pump is provided with automatic control means which activates the pump when fuel is needed at the burner nozzle. The pump is preferably positioned at an elevation about 1 to 15 feet higher than the level of the oil in the storage reservoir.

The nozzle 9 is preferably a dispersing spray type, having an open or partially occluded orifice.

The filter 6 may utilize a candle-type principle of operation or equivalent constructions. It is preferably designed to remove suspended particles having sizes greater than about 10 microns. The filtration media may be woven wire or fabric, open-celled foams, paper structures, granular beds, wound strands, or other equivalent structures and materials.

The check valve 10 may utilize a butterfly type flap gate or spring-ball principle of operation.

The holding tank 7 may have a capacity of $\frac{1}{8}$ to $\frac{1}{2}$ gallons, and may be fabricated of metal, reinforced plastic, or equivalent rigid and durable materials.

The pipelines may consist of iron pipe, copper or plastic tubing or equivalent suitable conduit material and may have an inside diameter of between $\frac{1}{4}$ and $\frac{3}{8}$ inch. Pipe connections may be achieved where necessary by either threading, soldering, swaging or equivalent means.

In operation, when there is no fuel in the holding tank, the pump 8 withdraws fuel from storage reservoir 1 through suction line 4. The fuel travels within said suction line through check valve 10 and filter 6 to the suction port 12 of pump 8. A minor portion of the fuel stream is pressurized and advanced to the burner nozzle 9. The remaining, major portion of the fuel stream emerges from return port 13, enters return line 5, and travels to holding tank 7. The fuel in the holding tank raises float 23, which in turn opens drain block 29. The fuel taken into the suction port of the pump will then preferably come from the holding tank instead of the storage reservoir. The reason for this preference is that the fuel travels a longer path in going from the reservoir to the pump than in going from the holding tank to the pump. The longer path imposes greater frictional resistance or drag en route to the pump. As a consequence, the path of least resistance for fuel to travel to the suction port 12 is from the holding tank, not the storage reservoir. In preferred embodiments, the respective elevations of the pump, holding tank, and reservoir are such that there is a greater negative hydrostatic head or pressure between the reservoir and the pump than between the holding tank and pump. This differential hydrostatic pressure further favors the removal of fuel from the holding tank rather than the reservoir. In some embodiments, the holding tank provides a positive hydrostatic head to the pump while the reservoir provides a negative hydrostatic head.

In the event of malfunction of the float valve mechanism, fuel which may tend to fill and overflow the holding tank will be returned via the return line 5 to the storage reservoir.

The net result of the novel fuel flow arrangement of this invention is to cause only that amount of fuel to leave the storage reservoir and pass through the filter that is actually used by the burner. Whereas prior methods circulate 16 to 20 gallons per hour of fuel through the filter, the present invention causes only 0.75 to 3.0 gallons per hour of fuel to flow through the filter. Under normal circumstances, it can be assumed that the amount of suspended impurities removed by the filter is proportional to the amount of fuel flowing therethrough. The rate of clogging of the filter used in the system of the present invention is therefore about one tenth of the clogging rate of filters on conventional systems under normal circumstances. However, an even greater life expectancy of the filter is realized in the practice of the present invention because of the following factors: 1) The stagnant conditions in the storage vessel permit the sludge to settle to the bottom, in contrast to prior systems wherein the recirculating nature of the fuel keeps impurities suspended; and 2) immediately upon filling the storage reservoir with new oil from a supply truck, considerable re-dispersion of sediment occurs, and prevails for a period of time. During this period, conventional systems draw the usual amount of fuel through the filter, whereas the present system draws very little fuel.

Not only does the present fuel supply system minimize the frequency with which filters must be replaced, but it minimizes malfunctions caused by suspended debris entering the pump and/or nozzle. The holding tank can easily be installed into existing fuel supply systems, thereby converting such existing systems into that of the present invention.

Having thus described my invention, I claim:

1. In a system for the transfer and consumption of a liquid fuel comprising a storage reservoir for said fuel, a suction pipeline communicating with said reservoir and adapted to convey fuel away from said reservoir through a filter and to a fuel consuming means, a return pipeline adapted to convey unconsumed fuel back to said storage reservoir, and a pump having a suction port and return port, said suction port being coupled with said suction pipeline, the improvement comprising a holding tank interposed in said return pipeline in a manner such that unconsumed fuel emerging from the return port of said pump enters said tank, a float valve mechanism located within said tank and adapted to open drain means when fuel is present in said tank, said drain means communicating with said suction pipeline at a location between said filter and said fuel consuming means, and an overflow outlet in an upper portion of said tank communicating with said return pipeline, the respective elevations of said pump, holding tank and storage reservoir being such that there is a greater negative hydrostatic pressure between the reservoir and pump than between the holding tank and pump, and the path of least resistance for fuel to travel to said suction port is from said holding tank, not said storage reservoir.

* * * * *